US009229393B2

(12) United States Patent
Kanematsu et al.

(10) Patent No.: US 9,229,393 B2
(45) Date of Patent: Jan. 5, 2016

(54) FIXING DEVICE CONFIGURED TO FIX A TONER IMAGE ONTO A RECORDING MEDIUM AND IMAGE FORMING APPARATUS INCLUDING THE SAME

(71) Applicant: KYOCERA Document Solutions Inc., Osaka (JP)

(72) Inventors: Yoshiharu Kanematsu, Osaka (JP); Yoshihiro Yamagishi, Osaka (JP); Takashi Eiki, Osaka (JP); Takefumi Yotsutsuji, Osaka (JP); Eriko Hayashi, Osaka (JP); Hironori Takahashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/629,960

(22) Filed: Feb. 24, 2015

(65) Prior Publication Data

US 2015/0248089 A1 Sep. 3, 2015

(30) Foreign Application Priority Data

Feb. 28, 2014 (JP) ..... 2014-037659

(51) Int. Cl.
*G03G 15/20* (2006.01)

(52) U.S. Cl.
CPC ..... *G03G 15/2053* (2013.01); *G03G 15/2085* (2013.01); *G03G 2215/2038* (2013.01)

(58) Field of Classification Search
CPC ..... G03G 15/2053; G03G 15/2085
USPC ..... 399/329
See application file for complete search history.

(56) References Cited

U.S. PATENT DOCUMENTS

2011/0206427 A1* 8/2011 Iwaya et al. ..... 399/329
2011/0229228 A1* 9/2011 Yoshikawa et al. ..... 399/329
2013/0266355 A1* 10/2013 Yoshiura et al. ..... 399/329
2014/0186074 A1* 7/2014 Ishida ..... 399/329
2014/0376935 A1* 12/2014 Egi et al.

FOREIGN PATENT DOCUMENTS

JP 2003-302852 A 10/2003

* cited by examiner

*Primary Examiner* — Susan Lee
(74) *Attorney, Agent, or Firm* — Studebaker & Baker PC

(57) ABSTRACT

A fixing device includes a fixing belt, a pressuring member, a pressing member and a sheet member. The fixing belt is arranged rotatably and configured to extend along an axis direction. The pressuring member is arranged rotatably and configured to come into pressure contact with the fixing belt so as to form a fixing nip. The pressing member is configured to press the fixing belt to a side of the pressuring member and configured such that the fixing belt is interposed between the pressing member and the pressuring member. The sheet member is formed in a tubular shape and provided around the pressing member and configured to rotate with rotation of the fixing belt.

10 Claims, 6 Drawing Sheets

FIXING DEVICE CONFIGURED TO FIX A TONER IMAGE ONTO A RECORDING MEDIUM AND IMAGE FORMING APPARATUS INCLUDING THE SAME

INCORPORATION BY REFERENCE

This application is based on and claims the benefit of priority from Japanese Patent application No. 2014-037659 filed on Feb. 28, 2014, the entire contents of which are incorporated herein by reference.

BACKGROUND

The present disclosure relates to a fixing device configured to fix a toner image onto a recording medium and an image forming apparatus including the fixing device.

Conventionally, an electrographic image forming apparatus, such as a copying machine or a printer, includes a fixing device configured to fix a toner image onto a recording medium, such as a sheet. For the fixing device, a belt fixing manner is applied. The belt fixing manner is a manner to form a fixing nip by making a fixing belt and a pressuring member (e.g. a pressuring roller) come into pressure contact with each other.

For example, there is a fixing device including a fixing belt arranged rotatably, a pressuring member configured to come into pressure contact with the fixing belt so as to form a fixing nip, a pressing member configured such that the fixing belt is sandwiched between the pressing member and the pressuring member, and a sheet member provided around the pressing member.

In the fixing device configured as described above, when the fixing belt rotates, the fixing belt slides with respect to the sheet member which is fixedly arranged. According to this, there is a concern that the fixing belt and the sheet member are worn out rapidly and the product lifetime of the fixing belt and the sheet member is shortened.

SUMMARY

In accordance with an embodiment of the present disclosure, a fixing device includes a fixing belt, a pressuring member, a pressing member and a sheet member. The fixing belt is arranged rotatably and configured to extend along an axis direction. The pressuring member is arranged rotatably and configured to come into pressure contact with the fixing belt so as to form a fixing nip. The pressing member is configured to press the fixing belt to a side of the pressuring member and configured such that the fixing belt is interposed between the pressing member and the pressuring member. The sheet member is formed in a tubular shape and provided around the pressing member and configured to rotate with rotation of the fixing belt.

In accordance with an embodiment of the present disclosure, an image forming apparatus includes the above-mentioned fixing device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
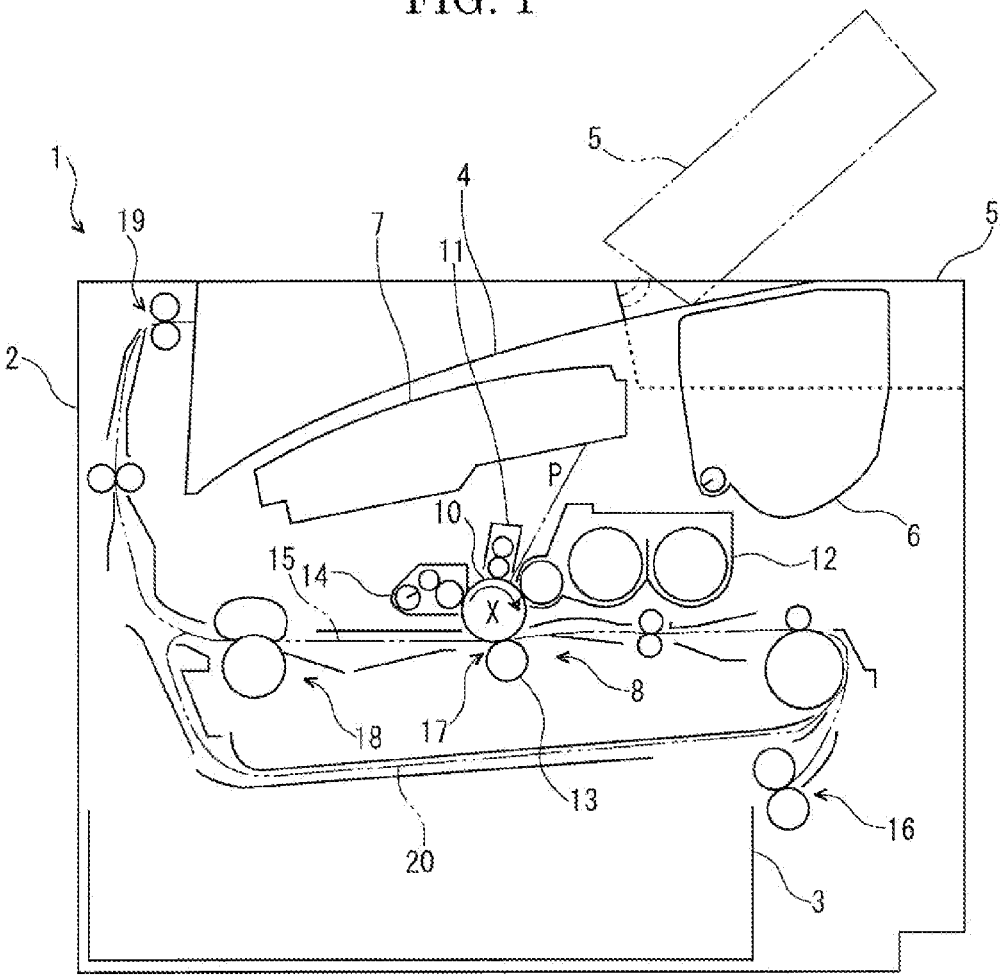
FIG. 1 is a schematic diagram showing a printer according to an embodiment of the present disclosure.

First, with reference to FIG. 1, the entire structure of a printer 1 (an image forming apparatus) will be described.

The printer 1 includes a box-like formed printer main body 2. In a lower part of the printer main body 2, a sheet feeding cartridge 3 storing sheets (recording mediums) is installed and, in a top face of the printer main body 2, an ejected sheet tray 4 is formed. To the top face of the printer main body 2, an upper cover 5 is openably/closably attached at a lateral side of the ejected sheet tray 4 and, below the upper cover 5, a toner container 6 is installed.

In an upper part of the printer main body 2, an exposure device 7 composed of a laser scanning unit (LSU) is located below the ejected sheet tray 4. Below the exposure device 7, an image forming part 8 is arranged. In the image forming part 8, a photosensitive drum 10 as an image carrier is rotatably arranged. Around the photosensitive drum 10, a charger 11, a development device 12, a transfer roller 13 and a cleaning device 14 are located along a rotating direction (refer to an arrow X in FIG. 1) of the photosensitive drum 10.

Inside the printer main body 2, a conveying path 15 for the sheet is arranged. At an upstream end in the conveying path 15, a sheet feeder 16 is positioned. At an intermediate stream part in the conveying path 15, a transferring part 17 composed of the photosensitive drum 10 and transfer roller 13 is positioned. At a downstream part in the conveying path 15, a fixing device 18 is positioned. At a downstream end in the conveying path 15, a sheet ejecting part 19 is positioned. Below the conveying path 15, an inversion path 20 for duplex printing is arranged.

Next, the operation of forming an image by the printer 1 having such a configuration will be described.

When the power is supplied to the printer 1, various parameters are initialized and initial determination, such as temperature determination of the fixing device 18, is carried out. Subsequently, in the printer 1, when image data is inputted and a printing start is directed from a computer or the like connected with the printer 1, image forming operation is carried out as follows.

First, the surface of the photosensitive drum 10 is electrically charged by the charger 11. Then, exposure corresponding to the image data is carried out to the photosensitive drum 10 by a laser light (refer to a two-dot chain line P in FIG. 1) from the exposure device 7, thereby forming an electrostatic latent image on the surface of the photosensitive drum 10. Subsequently, the development device 12 develops the electrostatic latent image to a toner image by a toner (a developer).

On the other hand, a sheet fed from the sheet feeding cartridge 3 by the sheet feeder 16 is conveyed to the transferring part 17 in a suitable timing for the above-mentioned image forming operation, and then, the toner image on the photosensitive drum 10 is transferred onto the sheet in the transferring part 17. The sheet with the transferred toner image is conveyed to a downstream side in the conveying path 15 to be inserted to the fixing device 18, and then, the toner image is fixed onto the sheet in the fixing device 18. The sheet with the fixed toner image is ejected from the sheet ejecting part 19 to the ejected sheet tray 4. The toner remained on the photosensitive drum 10 is collected by the cleaning device 14.

Figure 2:
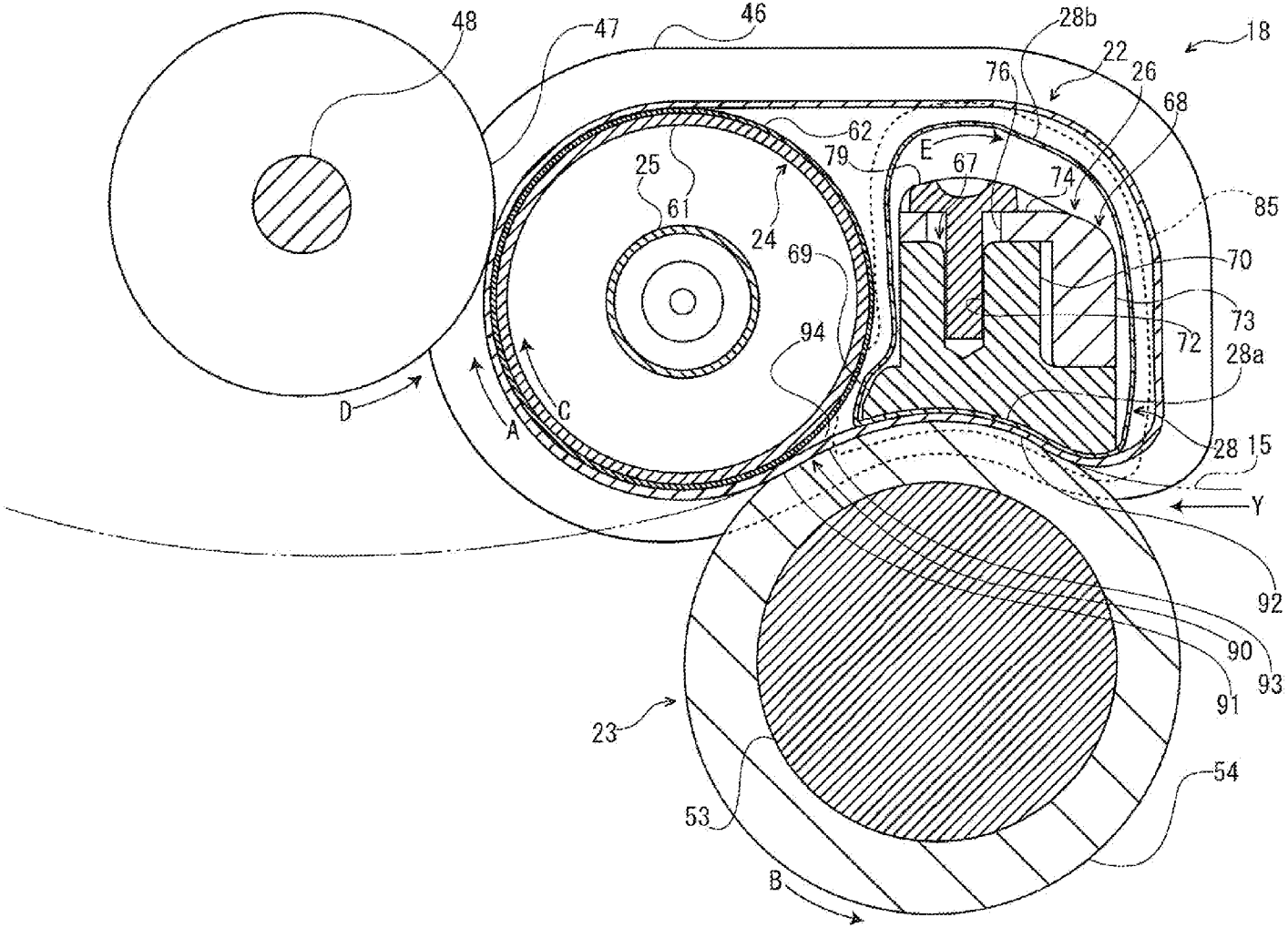
FIG. 2 is a sectional view showing a fixing device according to the embodiment of the present disclosure.

Next, the fixing device 18 will be described in detail with reference to FIGS. 2-5. For ease of description, a front side of FIG. 2 is a front side (front face side) of the fixing device 18. An arrow Y in FIG. 2 indicates a sheet conveying direction. An arrow Fr optionally assigned to each figure indicates a front side (front face side) of the fixing device 18. An arrow I in FIG. 4 indicates an inside in forward and backward directions, and an arrow O in FIG. 4 indicates an outside in the forward and backward directions.

Figure 3:
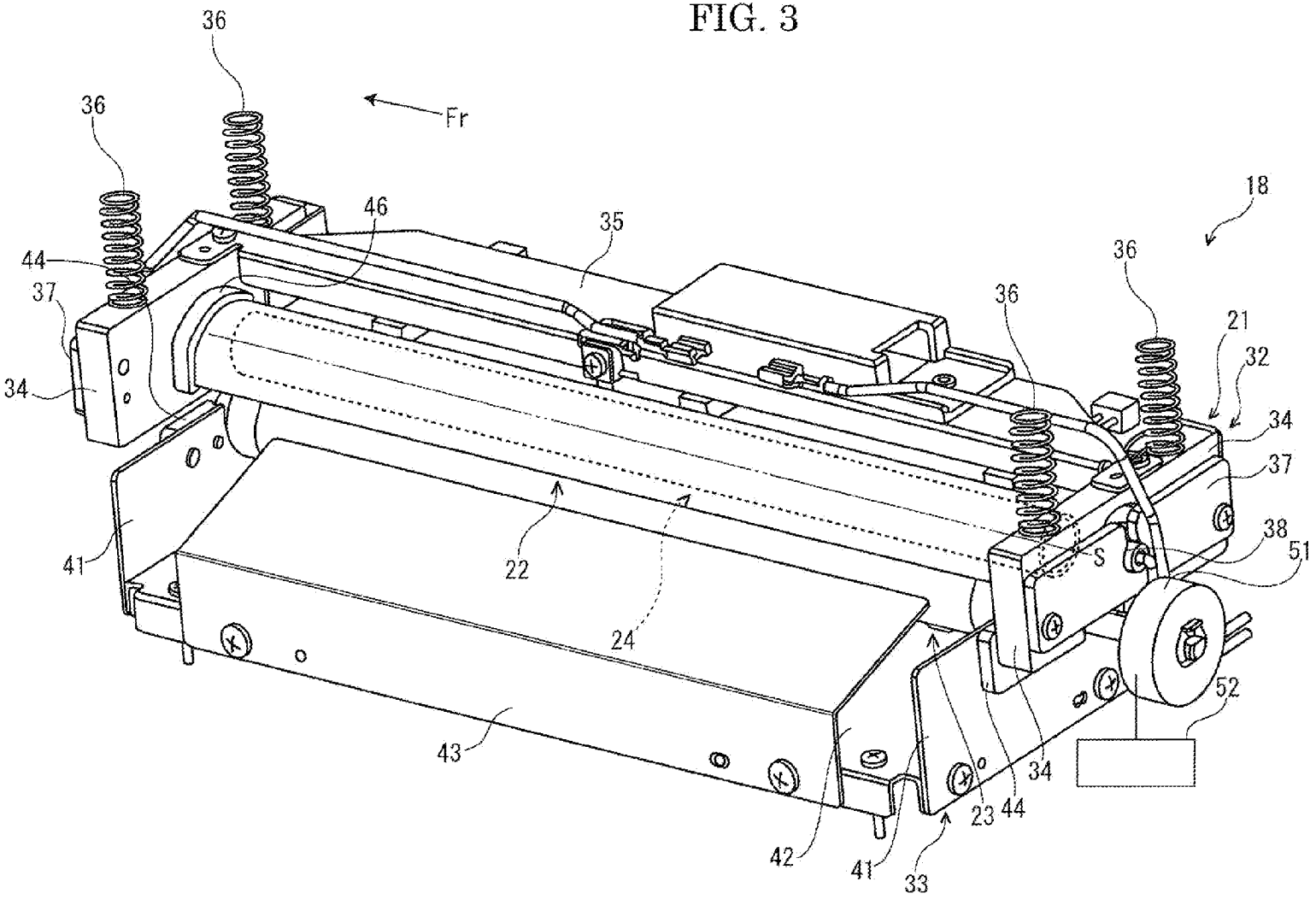
FIG. 3 is a perspective view showing the fixing device according to the embodiment of the present disclosure.

As shown in FIGS. 2 and 3, the fixing device 18 is provided with a fixing frame 21 (not shown in FIG. 2), a fixing belt 22 provided inside an upper part of the fixing frame 21, a pressuring roller 23 (pressuring member) provided inside a lower part of the fixing frame 21, a heating roller 24 (heating member) located inside the fixing belt 22 in a radial direction, a heater 25 (heat source) located inside the heating roller 24 in the radial direction, a pressing member 26 located at a right side (an upstream side in the sheet conveying direction) of the heating roller 24 and provided inside the fixing belt 22 in the radial direction and a sheet member 28 sandwiched between the fixing belt 22 and the pressing member 26.

As shown in FIG. 3, the fixing frame 21 includes an upper frame 32 and a lower frame 33. The upper frame 32 is movable to upward and downward with respect to the lower frame 33.

The upper frame 32 of the fixing frame 21 is provided with a pair of front and rear upper side base plates 34 extending in a vertical direction. Upper end parts of a pair of front and rear upper side base plates 34 are coupled by a coupling frame 35. With a top face of each of the upper side base plates 34, lower end parts of a pair of left and right coil springs (biasing members) come into contact. The coil springs 36 bias the upper frame 32 to a lower side (a side of the lower frame 33). To an external face of each of the upper side base plates 34, supporting piece 37 is fixed. In a center part in left and right directions of each supporting piece 37, attachment groove 38 is formed.

The lower frame 33 of the fixing frame 21 is provided with a pair of front and rear lower side base plates 41 extending in the vertical direction. Lower parts of a pair of front and rear lower side base plates 41 are coupled by a coupling plate 42. To both left and right edge parts of the coupling plate 42, guide plates 43 are fixed. Each guide plate 43 is bent toward an inside in the left and right directions, and extends to the side of the pressuring roller 23. To an external face of each of the lower side base plates 41, a bearing plate 44 is fixed.

The fixing belt 22 is formed in a cylindrical shape elongated in the forward and backward directions. The fixing belt 22 is flexible. The fixing belt 22 is biased to the lower side (a side of the pressuring roller 23) by the above-mentioned coil springs 36. The fixing belt 22 extends along the forward and backward directions. That is, in the present embodiment, the forward and backward directions are an axial line direction of the fixing belt 22. A two-dot chain line Z in FIG. 4 indicates the axial line direction (the forward and backward directions) of the fixing belt 22.

As shown in FIG. 2, the fixing belt 22 is provided around the heating roller 24, the pressing member 26 and the supporting member 27 in a state where an upper part of the fixing belt 22 is loose. The fixing belt 22 is arranged rotatably. An arrow A in FIG. 2 indicates a rotation direction of the fixing belt 22.

The fixing belt 22 has a diameter of 24 mm, for example. The fixing belt 22 is provided with, for example, a base material layer, an elastic layer provided around this base material layer and a release layer covering this elastic layer. The base material layer of the fixing belt 22 is made of PI (polyimide) having a thickness of 50 μm, for example. The elastic layer of the fixing belt 22 is made of silicon rubber having a thickness of 200 μm, for example. The release layer of the fixing belt 22 is made of a PFA coating having a thickness of 10 μm, for example. In addition, in each figure, each layer (the base material layer, the elastic layer and the release layer) of the fixing belt 22 is not distinguished.

Figure 4:
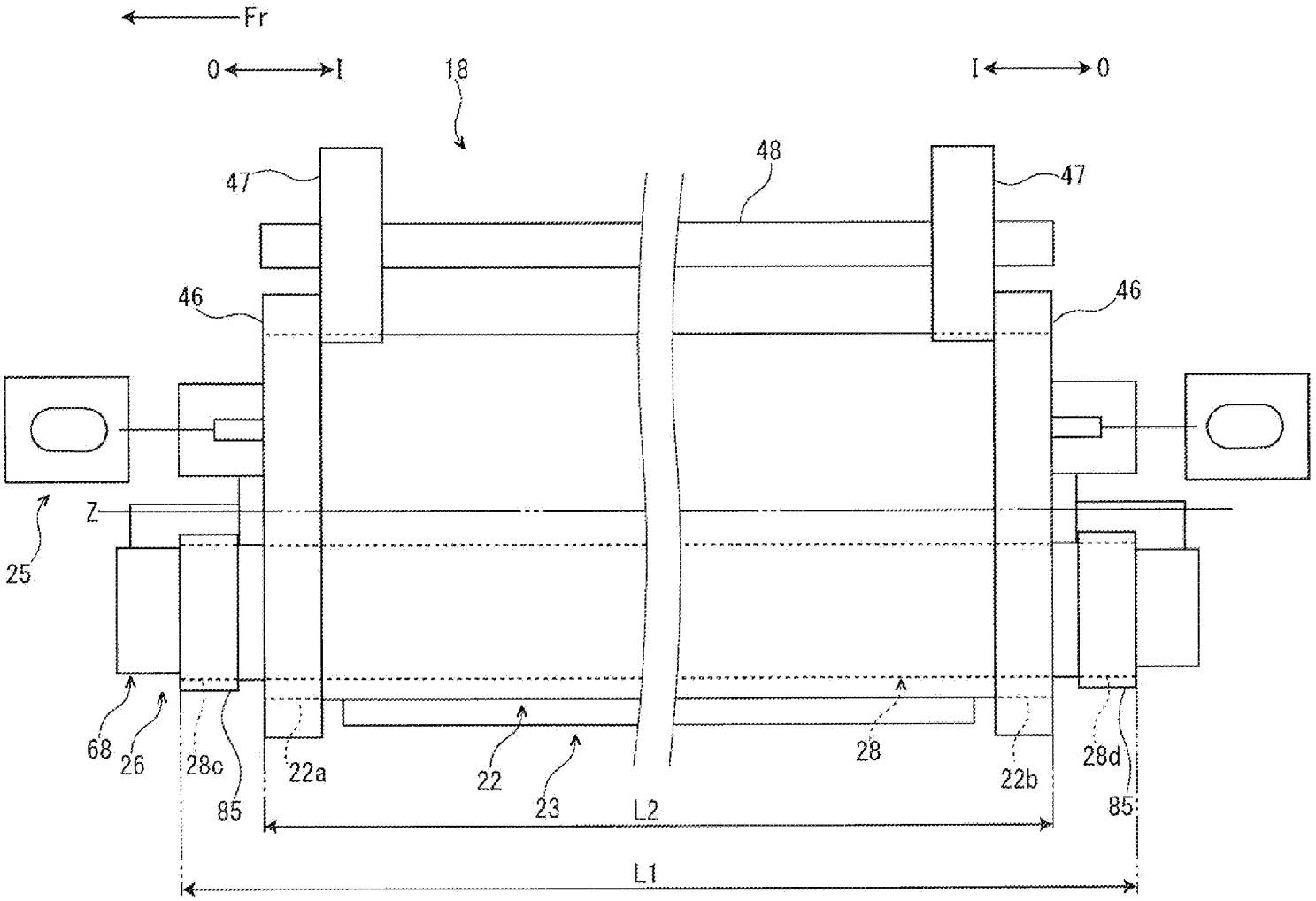
FIG. 4 is a plan view showing the fixing device according to the embodiment of the present disclosure.

As shown in FIG. 4, to outer circumference faces (outer circumferences) of both end parts 22A and 22B of the fixing belt 22 in the forward and backward directions, inside guide rails 46 (inside guide parts) are fixed. Each inside guide rail 46 is formed in an endless shape (annular shape). Each inside guide rail 46 is made of an elastic material such as silicon rubber. The respective inside guide rails 46 are provided at whole areas of the outer circumferences of the both end parts 22A and 22B of the fixing belt 22 in the forward and backward directions. Each inside guide rail 46 is fixed to the outer circumference face of the fixing belt 22 by a fixing method such as adhesion.

Inside of each inside guide rail 46 in the forward and backward directions (a rear side of the front inside guide rail 46 and a front side of the rear inside guide rail 46), a regulating roller 47 (regulating member) is located. Each regulating roller 47 is formed in a cylindrical shape. Each regulating roller 47 is made of silicon, fluorine resin, PPS (polyphenylene sulfide), peek (polyether ether ketone), PI (polyimide) or PAI (polyamide imide), for example. Each regulating roller 47 is coaxially fixed to an outer circumference of a rotation axis 48 extending along the forward and backward directions, and can rotate with the rotation axis 48.

As shown in FIG. 2, each regulating roller 47 is configured such that the fixing belt 22 is sandwiched between each regulating roller 47 and the heating roller 24. Each regulating roller 47 comes into pressure contact with the fixing belt 22. Each regulating roller 47 is located at a downstream side of a fixing nip 90, which will be described later, in a rotation direction (see an arrow A in FIG. 2) of the fixing belt 22.

The pressuring roller 23 is formed in a columnar shape elongated in the forward and backward directions. As shown in FIG. 3 and the other figures, the pressuring roller 23 is located at a lower side (outside in a radial direction) of the fixing belt 22. The both front and rear end parts of the pressuring roller 23 are axially supported by the respective bearing plates 44 of the lower frame 33. Consequently, the pressuring roller 23 is rotatably supported by the lower frame 33. To the rear end part of the pressuring roller 23, a transmission gear 51 is fixed. The transmission gear 51 is connected to a driving source 52 such as a motor. According to this configuration, the driving source 52 is connected to the pressuring roller 23 via the transmission gear 51, and the pressuring roller 23 is configured to rotate when rotation of the driving source 52 is transmitted to the pressuring roller 23 via the transmission gear 51. That is, the driving source 52 is configured to rotate the pressuring roller 23.

As shown in FIG. 2, the pressuring roller 23 is provided with a core material 53 of a columnar shape (solid shape) and an elastic layer 54 provided around this core material 53, for example. The core material 53 of the pressuring roller 23 is made of metal such as aluminum, for example. The elastic layer 54 of the pressuring roller 23 is made of foamed silicon rubber having a diameter of 20 mm, a thickness of 5 mm and the hardness of 44°, for example. The elastic layer 54 of the pressuring roller 23 has a higher friction coefficient than that of the core material 53 of the pressuring roller 23. The pressuring roller 23 comes into pressure contact with the fixing belt 22 and at a part at which the fixing belt 22 and the pressuring roller 23 come into pressure contact, the fixing nip 90, which will be described in detail later, is formed.

The heating roller 24 is formed in a cylindrical shape elongated in the forward and backward directions. The heating roller 24 is configured such that the fixing belt 22 is sandwiched between the heating roller 24 and the pressuring roller 23. The heating roller 24 is provided with a base material layer 61 and a coating layer 62 covering this base material layer 61. The base material layer 61 of the heating roller 24 is made of aluminum having a diameter of 15 mm and a thickness of 1 mm, for example. The coating layer 62 of the heating roller 24 is made of silicon rubber having a thickness of 50 μm, for example. The coating layer 62 of the heating roller has a higher friction coefficient than that of the base material layer 61 of the heating roller 24. The coating layer 62 of the heating roller 24 comes into contact with an inner circumference face of the fixing belt 22.

The both front and rear end parts of the heating roller 24 are axially supported by the supporting pieces 37 of the upper frame 32 (see FIG. 3) via bearings (not shown). Thus, the heating roller 24 is supported by the upper frame 32 so that the heating roller 24 is rotatable around a rotation axis S (see FIG. 3) extending in the forward and backward directions. That is, in the present embodiment, the forward and backward directions are a rotation axis direction of the heating roller 24.

The heater 25 is formed in a shape elongated in the forward and backward directions. As shown in FIG. 2, the heater 25 is housed in a center part of the heating roller 24. The heater 25 is a halogen heater of 800 W, for example. The heater 25 is configured to generate heat by energization, and heat the heating roller 24. The both front and rear end parts of the heater 25 are inserted in the attachment groove 38 of each supporting pieces 37 of the upper frame 32 (see FIG. 3). Thus, the heater 25 is supported by the upper frame 32.

Figure 5:
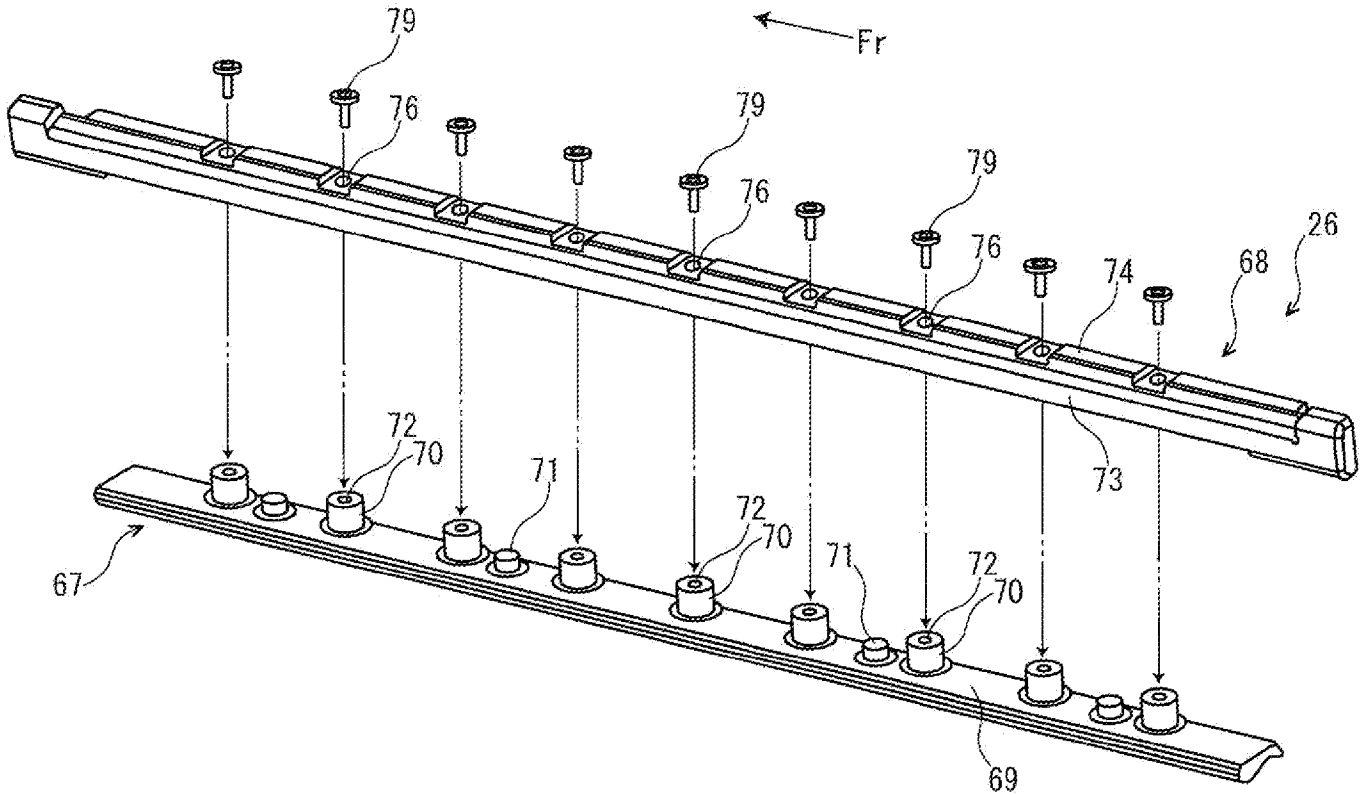
FIG. 5 is an exploded perspective view showing a pressing member in the fixing device according to the embodiment of the present disclosure.

The pressing member 26 is formed in a shape elongated in the forward and backward directions. The both front and rear end parts of the pressing member 26 are fixed to each upper side base plate 34 of the upper frame 32 (see FIG. 3). Thus, the pressing member 26 is supported by the upper frame 32. As shown in FIGS. 2 and 5, the pressing member 26 is provided with a pressing body 67, and an attachment body 68 located at an upper side of the pressing body 67.

The pressing body 67 of the pressing member 26 is made of heat-resistant resin such as liquid crystal polymer or PPS (polyphenylene sulfide) or metal such as SUS or iron, for example. The pressing body 67 is configured such that the fixing belt 22 is sandwiched between the pressing body 67 and the pressuring roller 23. The pressing body 67 presses the fixing belt 22 toward a lower side (the side of the pressuring roller 23).

The pressing body 67 is provided with a base part 69 and a plurality of projecting parts 70 formed in a top face of the base part 69. The base part 69 is formed in a flat shape elongated in the forward and backward directions. In the top face of the base part 69, projection parts 71 are formed between a plurality of projecting parts 70. A lower face of the base part 69 is curved in an arc shape along the outer circumference face of the pressuring roller 23. A plurality of projecting parts 70 are formed at intervals in the forward and backward directions. Each projecting part 70 is formed in a columnar shape. In a top face of each projecting part 70, a screw hole 72 is formed.

The attachment body 68 of the pressing member 26 is made of metal such as aluminum, SUS or iron. The attachment body 68 is formed in a shape elongated in the forward and backward directions. The attachment body 68 has a function of a base frame which supports the pressing body 67.

The attachment body 68 is provided with a sidewall part 73 extending in the vertical direction, and an upper wall part 74 bent from an upper end of the sidewall part 73 to the left side (inside in the left and right directions). In the upper wall part 74, a plurality of through-holes 76 are formed in upper and lower directions at intervals in the forward and backward directions. Further, a screw 79 which penetrates each through-hole 76 is screwed to the screw hole 72 of each projecting part 70, so that the attachment body 68 is attached to the pressing body 67.

The sheet member 28 is made of a low-friction material such as a glass cloth sheet, and has a lower friction coefficient than that of the pressing member 26. To a surface of the sheet member 28, a coating of fluorine resin such as PFA is applied.

As shown in FIG. 2 and other figures, the sheet member 28 is formed in a tubular shape, and is endless in a circumferential direction. The sheet member 28 extends along the forward and backward directions. The sheet member 28 is provided around the pressing member 26. In other words, the sheet member 28 is provided to cover the pressing member 26. A lower part 28*a* (a near side part to the fixing nip 90) of the sheet member 28 comes into contact with the inner circumference face of the fixing belt 22 and the lower face of the base part 69 of the pressing body 67 of the pressing member 26. An upper part 28*b* (a far side part from the fixing nip 90) of the sheet member 28 is located at a distance from the fixing belt 22 and the pressing member 26.

As shown in FIG. 4, a forward and backward direction length L1 of the sheet member 28 is longer than a forward and backward direction length L2 of the fixing belt 22. To outer circumference faces (outer circumferences) of both end parts 28*c* and 28*d* of the sheet member 28 in the forward and backward directions, outside guide rails 85 (outside guide parts) are fixed by a fixing method such as adhesion. Each outside guide rail 85 is formed in an endless shape (annular shape). Each outside guide rail 85 is made of an elastic material such as silicon rubber, and has flexibility. The respective outside guide rails 85 are provided at whole areas of the outer circumferences of the both end parts 28*c* and 28*d* of the sheet member 28 in the forward and backward directions. The outer diameter of each outside guide rail 85 is larger than the outer diameter of the sheet member 28.

Inside in the forward and backward directions of each outside guide rail 85 (a rear side of the front outside guide rail 85 and a front side of the rear outside guide rail 85), each inside guide rail 46 is located. As shown in FIG. 2, a lower side part (near side part to the fixing nip 90) of each outside guide rail 85 partially overlaps a lower side part (near side part to the fixing nip 90) of each inside guide rail 46 when seen along the forward and backward directions.

As shown in FIG. 2, at a part at which the fixing belt 22 and the pressuring roller 23 come into pressure contact, the fixing nip 90 is formed. The fixing nip 90 is provided with a first nip part 91, a second nip part 92 formed at the right side of the first nip part 91, and a third nip part 93 formed between the first nip part 91 and the second nip part 92.

The first nip part 91 is formed at a portion at which the fixing belt 22 is sandwiched between the pressuring roller 23 and the heating roller 24. The first nip part 91 is backed up by the heating roller 24 from the inside of the fixing belt 22 in the radial direction. A formation width of the first nip part 91 is 1.5 mm, for example.

The second nip part 92 is formed at a portion at which the fixing belt 22 is sandwiched between the pressuring roller 23 and the pressing body 67 of the pressing member 26. The second nip part 92 is backed up by the pressing body 67 of the pressing member 26 from the inside of the fixing belt 22 in the radial direction. The second nip part 92 is provided at an upstream side of the first nip part 91 in the rotation direction (see the arrow A in FIG. 2) of the fixing belt 22. A total sum of force to be applied to the second nip part 92 is larger than a total sum of force to be applied to the first nip part 91. That is, a force with which the fixing belt 22 is sandwiched between the pressuring roller 23 and the pressing body 67 of the pressing member 26 is larger than a force with which the fixing belt 22 is sandwiched between the pressuring roller 23 and the heating roller 24. A formation width of the second nip part 92 is 9 mm, for example.

The third nip part 93 is provided at a position meeting a gap 94 formed between a lower end part of the heating roller 24 and a lower end part of the base part 69 of the pressing body 67 of the pressing member 26. Hence, the third nip part 93 is not backed up from the inside of the fixing belt 22 in the radial direction. A formation width of the third nip part 93 is 1.5 mm, for example.

In the fixing device 18 configured as described above, when a toner image is fixed to a sheet, the driving source 52 is driven. When the driving source 52 is driven in this way, rotation of the driving source 52 is transmitted to the pressuring roller 23 via the transmission gear 51, and the pressuring roller 23 rotates as indicated by an arrow B in FIG. 2. When the pressuring roller 23 is rotated by the driving source 52 in this way, the fixing belt 22 rotates with rotation of the pressuring roller 23 as indicated by the arrow A in FIG. 2. Further, as indicated by an arrow C in FIG. 2, the heating roller 24 rotates with rotation of the fixing belt 22. In addition, the fixing belt 22 rotates from the side of the pressing member 26 to the side of the heating roller 24 in a state where the fixing belt 22 is sandwiched between the pressuring roller 23 and the heating roller 24.

When the fixing belt 22 rotates as described above, as indicated by the arrow D in FIG. 2, each regulating roller 47 coming into pressure contact with the fixing belt 22 rotates with rotation of the fixing belt 22. In addition, as indicated by the arrow E in FIG. 2, the sheet member 28 rotates around the pressing member 26 with rotation of the fixing belt 22.

Further, when a toner image is fixed to a sheet, the heater 25 is operated (turned on). When the heater 25 is operated in this way, the heating roller 24 is heated by the heater 25 from the inside in the radial direction, and the fixing belt 22 is heated from the inside in the radial direction by heat transfer from the heating roller 24. When the sheet passes through the fixing nip 90 in this state, a toner image is heated and pressured, and is fixed to the sheet.

In the present embodiment, as described above, the sheet member 28 rotates with rotation of the fixing belt 22. Consequently, it is possible to prevent friction between the fixing belt 22 and the sheet member 28 compared to a case where the fixing belt 22 slides with respect to the sheet member 28 which is fixedly arranged. According to this, it is possible to prolong product lifetime of the fixing belt 22 and the sheet member 28.

Further, inside in the forward and backward directions of the respective outside guide rails 85 fixed to the outer circumference faces of the both end parts 28*c* and 28*d* of the sheet member 28 in the forward and backward directions, the respective inside guide rails 46 fixed to the outer circumference faces of the both end parts 22*a* and 22*b* of the fixing belt 22 in the forward and backward directions are located. By applying such a configuration, when the sheet member 28 is moved to one side in the forward and backward directions (a front end side or a rear end side), the outside guide rail 85 comes into contact with the inside guide rail 46, so that movement of the sheet member 28 to one side in the forward and backward directions is regulated. Consequently, it is possible to prevent the sheet member 28 from being greatly moved to one side in the forward and backward directions, and it is possible to prevent a position of the sheet member 28 from being displaced with respect to the fixing belt 22 and the pressing member 26.

Further, inside in the forward and backward directions of each inside guide rail 46, each regulating roller 47 is located. By applying such a configuration, when the fixing belt 22 is moved to one side in the forward and backward directions (the front end side or the rear end side), the inside guide rail 46 comes into contact with the regulating roller 47, so that movement of the fixing belt 22 to one side in the forward and backward directions is regulated. Consequently, it is possible to prevent the fixing belt 22 from being greatly moved to one side in the forward and backward directions. According to this, it is possible to prevent the both end parts 22*a* and 22*b* of the fixing belt 22 in the forward and backward directions from coming into contact with other members located at one side in the forward and backward directions of the fixing belt 22, and it is possible to prevent the both end parts 22*a* and 22*b* of the fixing belt 22 in the forward and backward directions from being buckled and damaged. Further, the sheet member 28 is prevented from being moved to one side in the forward and backward directions, too. Consequently, it is possible to more effectively prevent the sheet member 28 from being displaced with respect to the fixing belt 22 and the pressing member 26.

Furthermore, the lower part 28*a* (the near side part to the fixing nip 90) of the sheet member 28 comes into contact with the lower face of the base part 69 of the pressing body 67 of the pressing member 26, and the upper part 28*b* (the far side part from the fixing nip 90) of the sheet member 28 is located at a distance from the pressing member 26. By applying such a configuration, it is possible to decrease a contact area of the sheet member 28 and the pressing member 26 compared to a case where both of the lower part 28*a* and the upper part 28*b* of the sheet member 28 come into contact with the pressing member 26. According to this, it is possible to reduce a sliding load with respect to the pressing member 26 of the sheet member 28, and it is possible to more effectively prevent friction of the sheet member 28.

Further, not only the fixing belt 22 is sandwiched between the pressing body 67 of the pressing member 26 and the pressuring roller 23, but also the fixing belt 22 is sandwiched between the heating roller 24 and the pressuring roller 23. By applying such a configuration, it is possible to increase a formation width of the fixing nip 90, and reliably fix a toner image to a sheet.

Further, in the present embodiment, the coating layer 62 of the heating roller 24 having a higher friction coefficient than that of the base material layer 61 of the heating roller 24 comes into contact with the inner circumference face of the fixing belt 22. By applying such a configuration, the pressuring roller 23 and the heating roller 24 can strongly grip the fixing belt 22, and the first nip part 91 of the fixing nip 90 can pull the fixing belt 22 to the left side (the downstream side in the rotation direction of the fixing belt 22). According to this, the fixing belt 22 is stretched between the first nip part 91 and the second nip part 92 of the fixing nip 90. Consequently, it is possible to effectively prevent the fixing belt 22 from being deflected or buckled by the third nip part 93 of the fixing nip 90 and suppress image deterioration.

Figure 6:
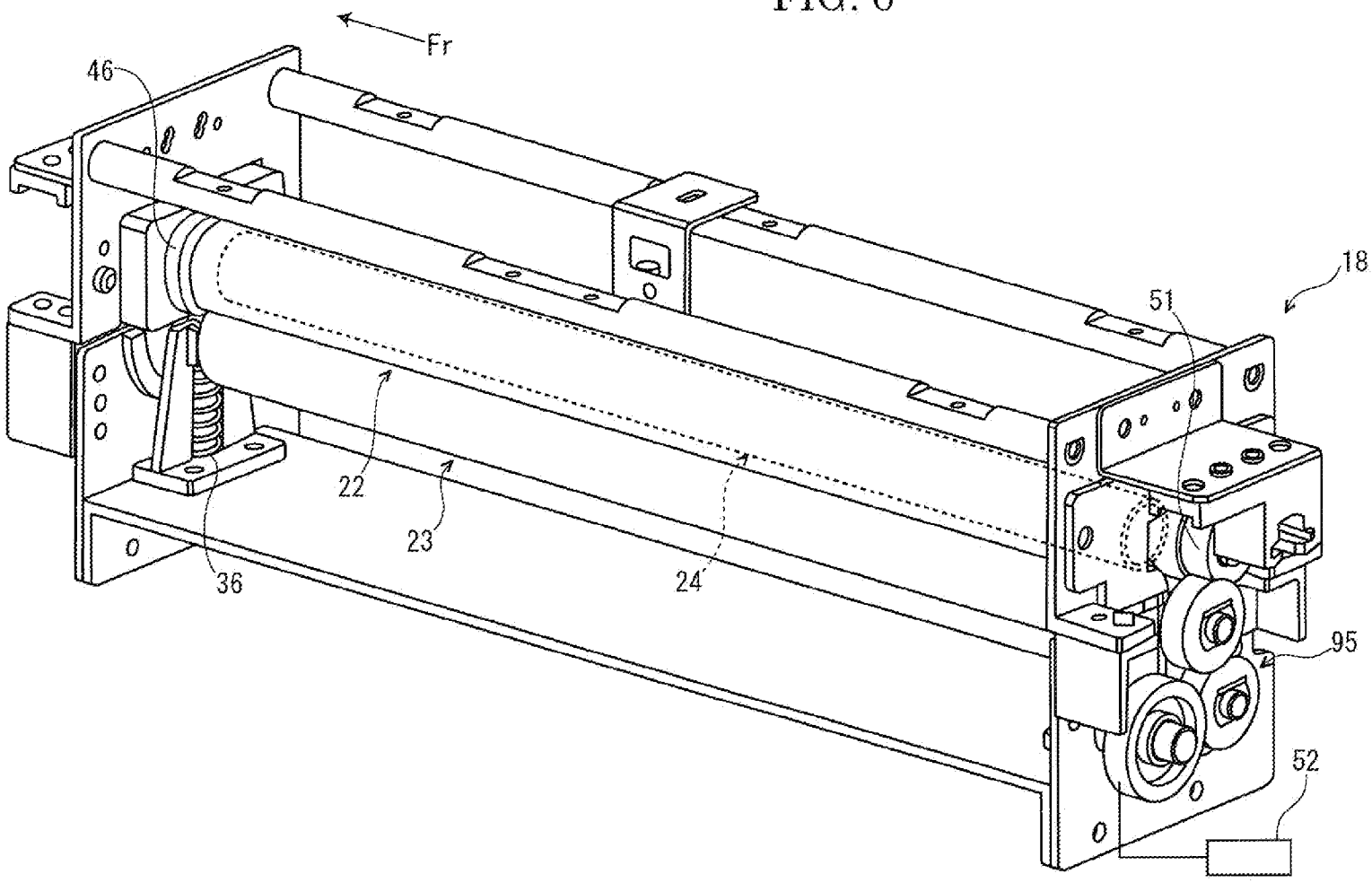
FIG. 6 is a perspective view showing a fixing device according to another embodiment of the present disclosure.

In the present embodiment, a case where the transmission gear 51 is fixed to the pressuring roller 23 and the driving source 52 is connected to the pressuring roller 23 via this transmission gear 51 has been described. Meanwhile, in the other different embodiments, as shown in FIG. 6, the transmission gear 51 may be fixed to the heating roller 24, and the driving source 52 may be connected to the heating roller 24 via this transmission gear 51 and a gear train 95. In this case, when the heating roller 24 is rotated by the driving source 52, the fixing belt 22 and the pressuring roller 23 rotate with the rotation of the heating roller 24.

In the present embodiment, a case where the fixing belt 22 is biased to the lower side (the side of the pressuring roller 23) by the coil springs 36 (biasing members) has been described. Meanwhile, in the other different embodiments, as shown in FIG. 6, the pressuring roller 23 may be biased to the upper side (the side of the fixing belt 22) by the coil springs 36 (biasing members).

In the present embodiment, a case where each regulating roller 47 is located at the downstream side of the fixing nip 90 in the rotation direction of the fixing belt 22 has been described. Meanwhile, in the other different embodiments, each regulating roller 47 may be located at an upstream side of the fixing nip 90 in the rotation direction of the fixing belt 22.

In the present embodiment, a case where rotatable regulating rollers 47 are used as regulating members has been described. Meanwhile, in the other different embodiments, a regulating guide which is not rotatable may be used as a regulating member.

In the present embodiment, a case where the upper part 28*b* (a far side part from the fixing nip 90) of the sheet member 28 is located at a distance from the fixing belt 22 and the pressing member 26 has been described. Meanwhile, in the other different embodiments, the upper part 28*b* (a far side part from the fixing nip 90) of the sheet member 28 may be in contact with one or both of the fixing belt 22 and the pressing member 26.

In the present embodiment, a case where outside guide rails 85 are fixed to outer circumference faces of both end parts 28*c* and 28*d* of the sheet member 28 in the forward and backward directions has been described. Meanwhile, in the other different embodiments, outside guide rails 85 may be fixed to both end face of the sheet member 28 in the forward and backward directions.

In the present embodiment, a case where the fixing belt 22 is provided around the heating roller 24 and the pressing member 26 in a state where the upper part of the fixing belt 22 is loose has been described. Meanwhile, in the other different embodiments, the fixing belt 22 may be provided around the heating roller 24 and the pressing member 26 in a state without any looseness.

In the present embodiment, a case where the base material layer of the fixing belt 22 is made of resin (PI (polyimide)) has been described. Meanwhile, in the other different embodiments, the base material layer of the fixing belt 22 may be made of metal such as SUS or nickel.

In the present embodiment, a case where the pressuring roller 23 is provided with the core material 53 and the elastic layer 54 has been described. Meanwhile, in the other different embodiments, the pressuring roller 23 may be provided with the core material 53 and the elastic layer 54, and, in addition, a release layer covering the elastic layer 54. The release layer of the pressuring roller 23 is made of a PFA tube, for example.

In the present embodiment, a case where the heater 25 composed of the halogen heater is used as a heat source has been described. Meanwhile, in the other different embodiments, a carbon heater, a ceramic heater or an IH (Induction Heating) coil or the like may be used as the heat source.

In the present embodiment, a case where the fixing belt 22 is sandwiched between the pressuring roller 23 and both of the heating roller 24 and the pressing member 26 has been described. Meanwhile, in the other different embodiments, the fixing belt 22 may be sandwiched between the pressuring roller 23 and either one of the heating roller 24 and the pressing member 26. In a case where the fixing belt 22 is sandwiched between the pressuring roller 23 and the heating roller 24 (a case where pressing member 26 is not used), the fixing belt 22 may be provided around the heating roller or wound around the heating roller and another roller.

In the present embodiment, a case where the configuration of the present disclosure is applied to the printer 1 has been described. Meanwhile, in the other different embodiments, the configuration of the disclosure may be applied to another image forming apparatus, such as a copying machine, a facsimile or a multifunction peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device comprising:

a fixing belt arranged rotatably and configured to extend along an axis direction;

a pressuring member arranged rotatably and configured to come into pressure contact with the fixing belt so as to form a fixing nip;

a pressing member configured to press the fixing belt to a side of the pressuring member and configured such that the fixing belt is interposed between the pressing member and the pressuring member;

a tubular sheet member provided around the pressing member and configured to rotate with rotation of the fixing belt;

an outside guide part configured to be fixed to outer circumference of an end part of the sheet member in the axis direction; and an inside guide part configured to be fixed to outer circumference of an end part of the fixing belt in the axis direction and located inside of the outside guide part in the axis direction.

2. The fixing device according to claim 1, further comprising a regulating member located inside of the inside guide part in the axis direction.

3. The fixing device according to claim 1, wherein the outside guide part and the inside guide part are made of elastic material and flexible.

4. The fixing device according to claim 1, wherein the outside guide part is provided at a whole area of the outer circumference of the end part of the sheet member in the axis direction, the inside guide part is provided at a whole area of the outer circumference of the end part of the fixing belt in the axis direction.

5. An image forming apparatus comprising the fixing device according to claim 1.

6. A fixing device comprising:

a fixing belt arranged rotatably and configured to extend along an axis direction;

a pressuring member arranged rotatably and configured to come into pressure contact with the fixing belt so as to form a fixing nip;

a pressing member configured to press the fixing belt to a side of the pressuring member and configured such that the fixing belt is interposed between the pressing member and the pressuring member; and a tubular sheet member provided around the pressing member and configured to rotate with rotation of the fixing belt, wherein a near side part to the fixing nip of the sheet member comes into contact with the pressing member, and a far side part from the fixing nip of the sheet member is located at a distance from the pressing member.

7. An image forming apparatus comprising the fixing device according to claim 6.

8. A fixing device comprising:

a fixing belt arranged rotatably and configured to extend along an axis direction;

a pressuring member arranged rotatably and configured to come into pressure contact with the fixing belt so as to form a fixing nip;

a pressing member configured to press the fixing belt to a side of the pressuring member and configured such that the fixing belt is interposed between the pressing member and the pressuring member;

a tubular sheet member provided around the pressing member and configured to rotate with rotation of the fixing belt; and a heating member arranged rotatably and configured such that the fixing belt is interposed between the heating member and the pressuring member.

9. The fixing device according to claim 8, further comprising a heat source located inside of the heating member in a radial direction.

10. An image forming apparatus comprising the fixing device according to claim 8.

* * * * *